US005105170A

United States Patent [19]

Joshi

[11] Patent Number: 5,105,170

[45] Date of Patent: Apr. 14, 1992

[54] WAVEGUIDE COUPLING NETWORKS

[75] Inventor: Jai S. Joshi, Stevenage, United Kingdom

[73] Assignee: British Aerospace public limited company, London, England

[21] Appl. No.: 552,193

[22] Filed: Jul. 13, 1990

[30] Foreign Application Priority Data

Jul. 15, 1989 [GB] United Kingdom ..... 8916264
Nov. 2, 1989 [GB] United Kingdom ..... 8924752

[51] Int. Cl.[5] ..... H01P 5/18
[52] U.S. Cl. ..... 333/113; 330/295
[58] Field of Search ..... 333/113, 114; 343/776; 330/295

[56] References Cited

U.S. PATENT DOCUMENTS 2,568,090 9/1951 Riblet ..... 333/113 X
2,585,173 2/1952 Riblet ..... 333/113
2,909,655 10/1959 Sanner ..... 333/113 X

FOREIGN PATENT DOCUMENTS 0041877 12/1981 European Pat. Off. .
818450 8/1959 United Kingdom .
820632 9/1959 United Kingdom .
871383 6/1961 United Kingdom .
890846 3/1962 United Kingdom .
926343 5/1963 United Kingdom ..... 333/113
929289 6/1963 United Kingdom .
1005378 9/1965 United Kingdom .
1180714 2/1970 United Kingdom .

OTHER PUBLICATIONS

British Search Report.

*Primary Examiner*—Paul Gensler
*Attorney, Agent, or Firm*—Nixon & Vanderhye

[57] ABSTRACT

A waveguide coupling network for the output or input network of a shared power amplification module comprises a plurality of waveguides interconnected by side or top wall coupling to make up a network in which the phase and amplitude coherence of the network is substantially preserved.

6 Claims, 9 Drawing Sheets

WAVEGUIDE COUPLING NETWORKS

BACKGROUND OF THE INVENTION

1. Field of the Invention

This invention relates to waveguide coupling networks and in particular, but not exclusively, to output coupling networks for hybrid transponders and to hybrid transponders incorporating such networks.

2. Discussion of Prior Art

A hybrid transponder, also known as a shared power amplification module, has been described in the article "An adaptive multiple beam system concept" by S. Egami and M. Kawai in IEEE Journal on Selected Areas in Communications, Volume SAC-5, No. 4, May 1987. FIG. 1 of the accompanying drawings shows a four-way Hybrid Transponder. The four input signals are split and combined in the input network of 90° hybrids in such a manner that all four amplifiers have identical signal levels incident on them. The amplified outputs are combined by the output network of 90° hybrids such that the signal at No. 1 input appears at No. 4 output alone, No. 2 input at No. 3 output, No. 3 input at No. 2 output and No. 4 input at No. 1 output.

The output network must be able to handle high power levels and it is important that signal losses through the output are minimal to maximize overall efficiency. The lowest possible loss medium for microwave transmission is considered to be waveguide. An important requirement in many applications is that the network should maintain amplitude and phase coherence of all the different paths. In other words, the electrical length and loss from any input terminal to any output terminal of the network should be the same. The arrangement of FIG. 1 requires cross-linking between diagonally opposed 90° hybrids of the output network, as shown in FIG. 2 of the accompanying drawings. This would normally necessitate use of bends or cross-overs which add to the size of the network and may cause amplitude and phase mismatch.

A need exists, therefore, for a compact network which provides amplitude and phase coherent interconnections in a compact arrangement.

SUMMARY OF THE INVENTION

According to one aspect of this invention, there is provided a waveguide network including a plurality of waveguide means interconnected by side and/or top wall couplings whereby a signal introduced into any one waveguide means is distributed between all of said plurality thereof.

According to another aspect of this invention, there is provided a waveguide network comprising eight substantially L-shaped waveguide means each having an upstream region and a downstream region, arranged in two contiguous generally parallel groups of four, the waveguide means in each group being arranged such that each upstream region of a waveguide means is coupled to the upstream region of an adjacent one of the other waveguide means in the group and each downstream region is coupled to an adjacent one of the other waveguide means in the group, whereby each group defines a generally cruciform arrangement with two opposed pairs of inlets and two opposed pairs of outlets, the outlets of each pair thereof in one group being coupled to respective ones of the outlets in the corresponding pair in the other group, whereby the signal applied to any waveguide means is distributed between each of the eight waveguide means.

According to another aspect of this invention, there is provided a waveguide coupling network comprising a plurality of adjacent waveguide means, one of said waveguide means including a side wall coupling aperture and a top wall coupling aperture, wherein each of said apertures couples said one waveguide means to a respective adjacent waveguide means, to define at least two interconnected hybrid couplers.

The invention also extends to a shared power amplifier or hybrid transponder incorporating an output coupling network as defined above.

Although the invention has been described above it includes any inventive combination of the features set out below or in the appended claims.

BRIEF DISCUSSION OF THE DRAWINGS

The invention may be performed in various certain embodiments thereof will now be described by way of example only, reference being made to the accompanying drawings, in which.

Figure 5A:
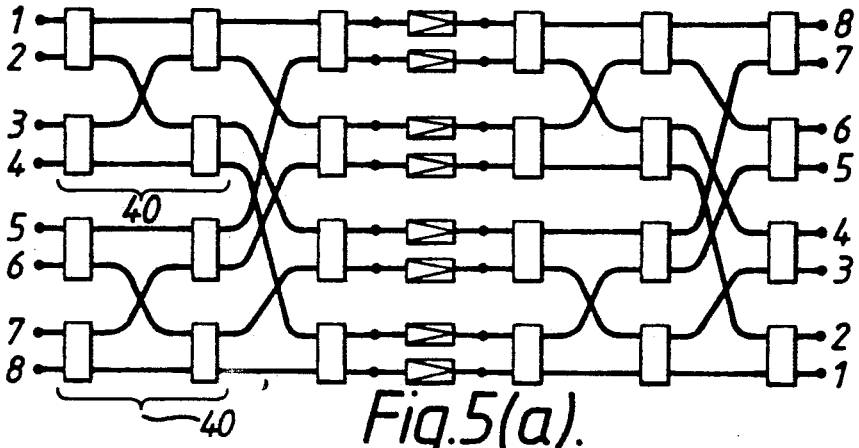
Figure 5B:
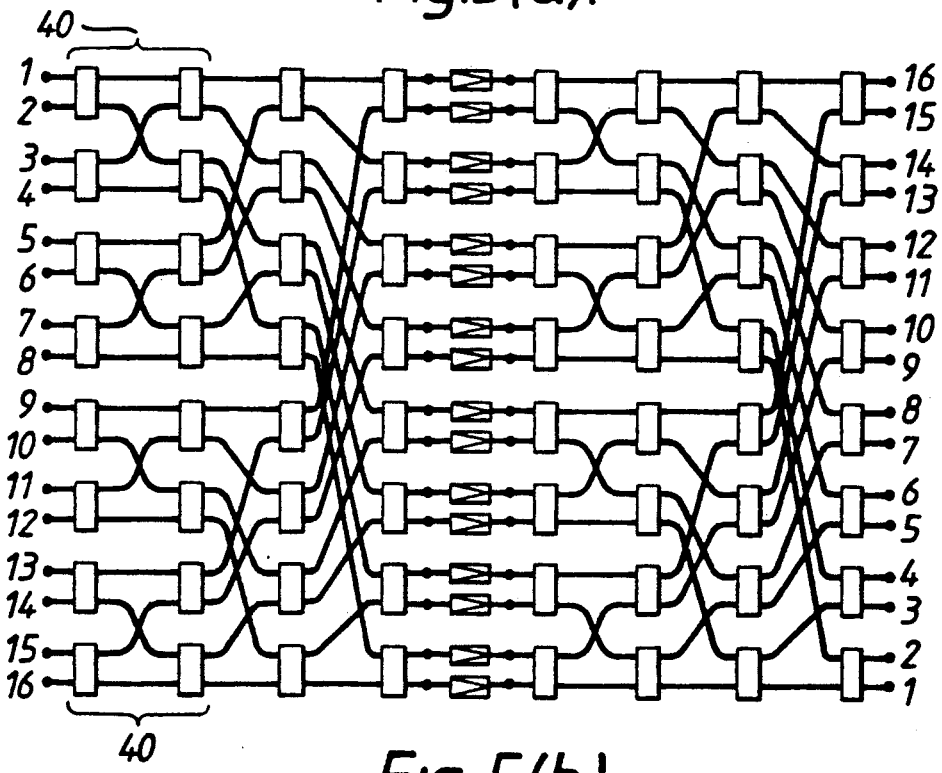
Figure 6:
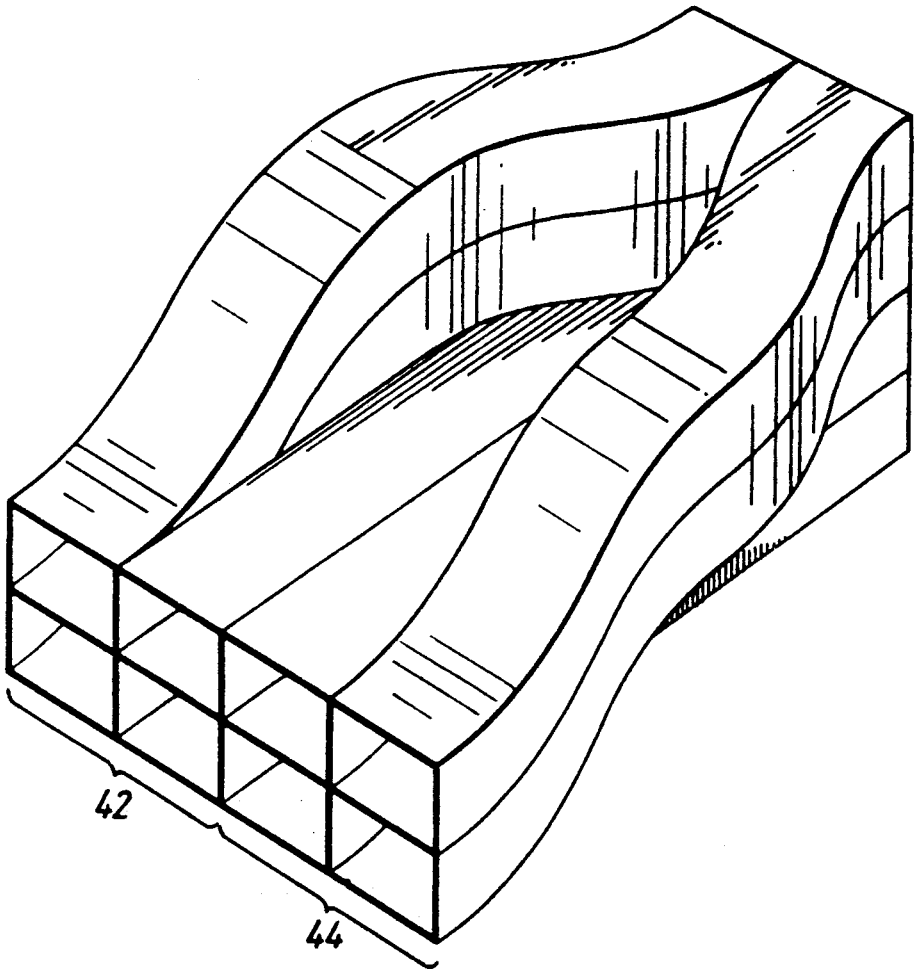

FIGS. 5(*a*) and (*b*) show schematically the interconnection for an 8-way and a 16-way shared power amplification module respectively, FIG. 6 is a general perspective sketch of an 8-way output coupling network in accordance with the invention.

Figure 7:
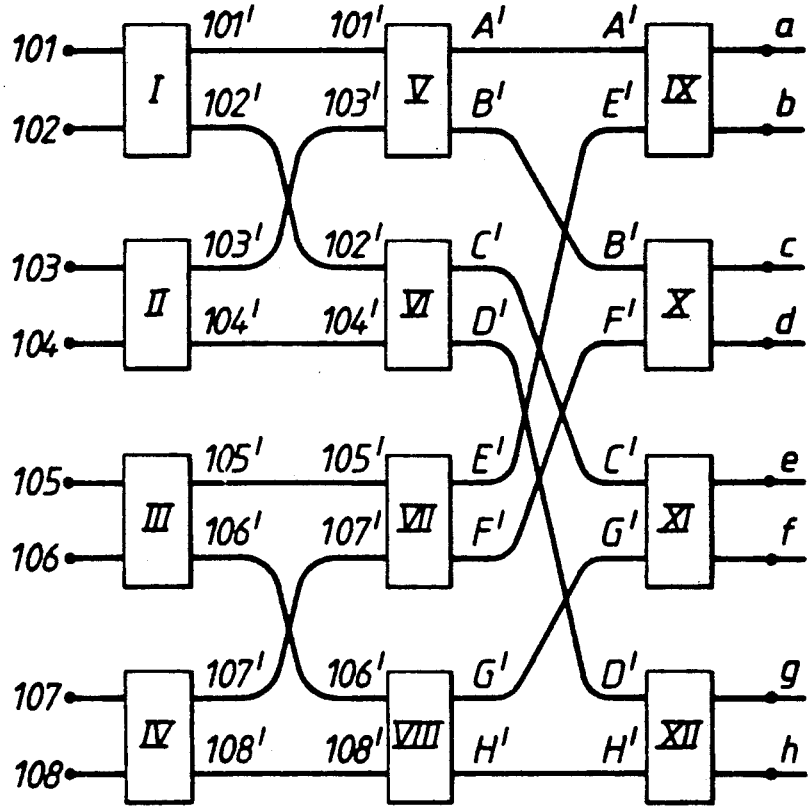
Figure 8:
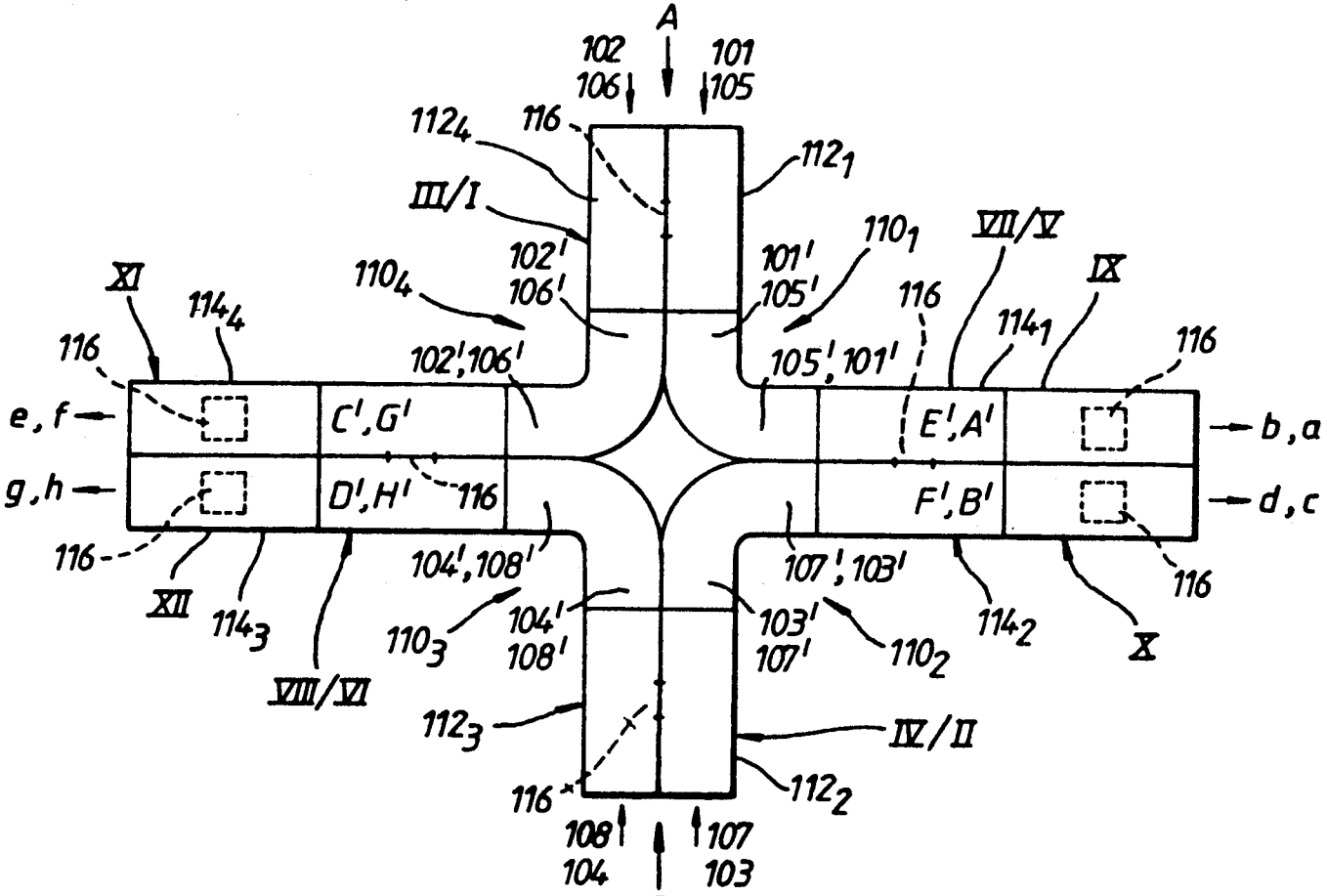
Figure 9A:
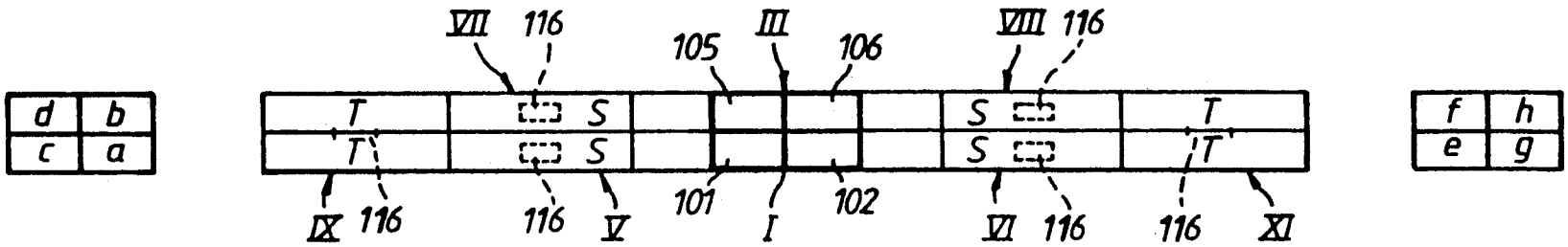
Figure 9B:
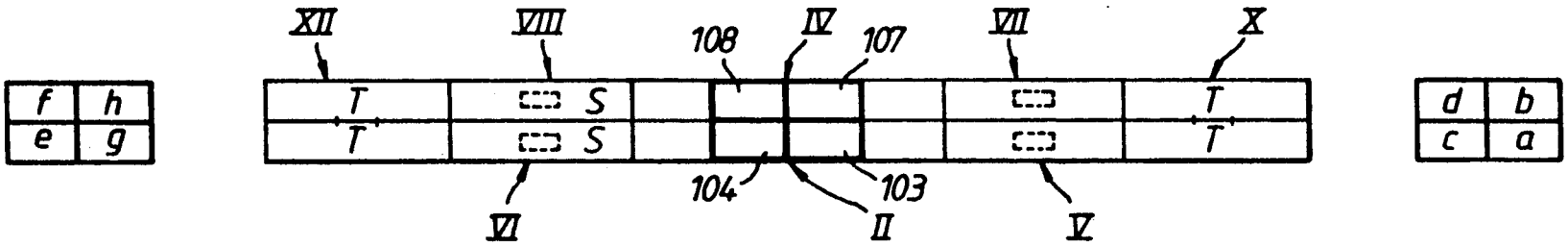
Figure 10:
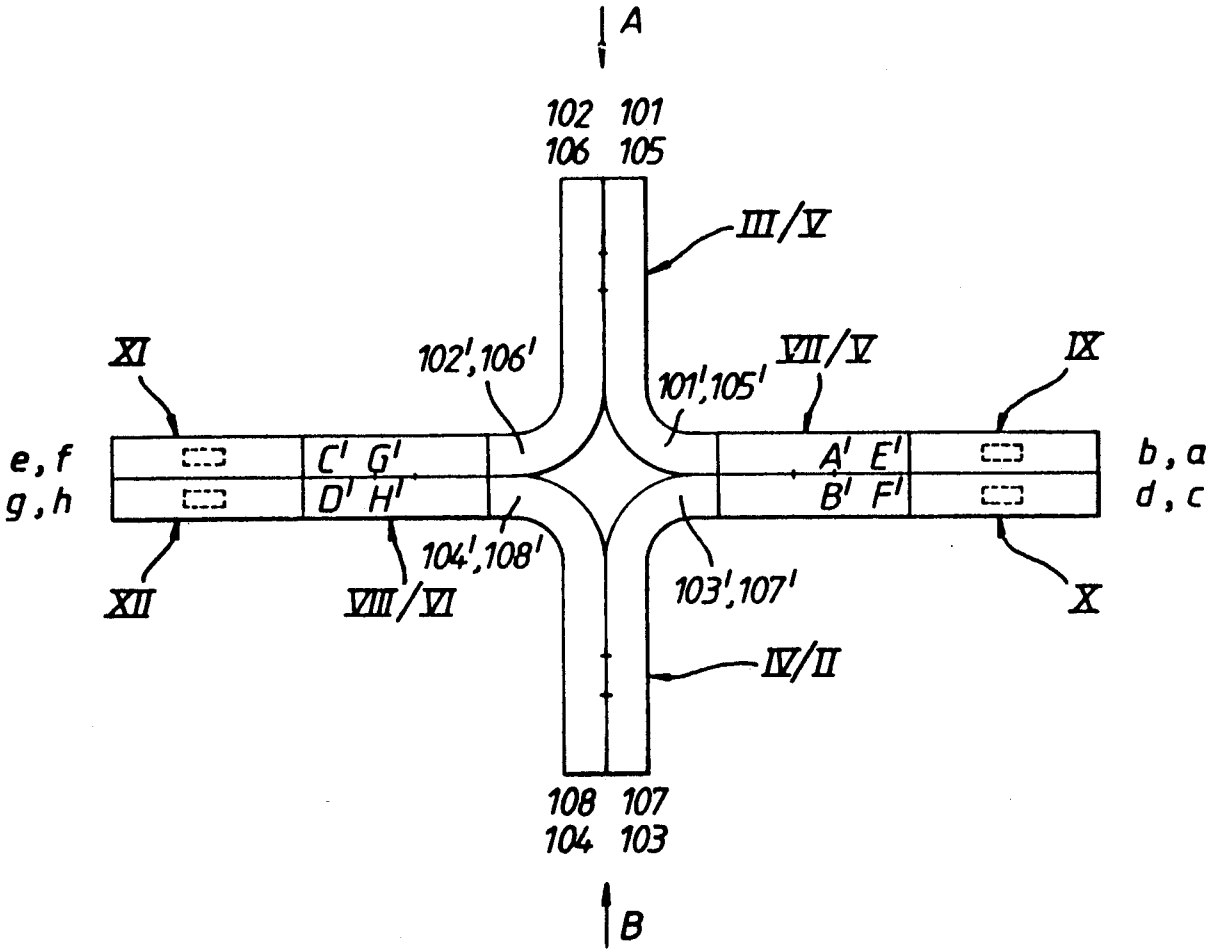
Figure 11A:
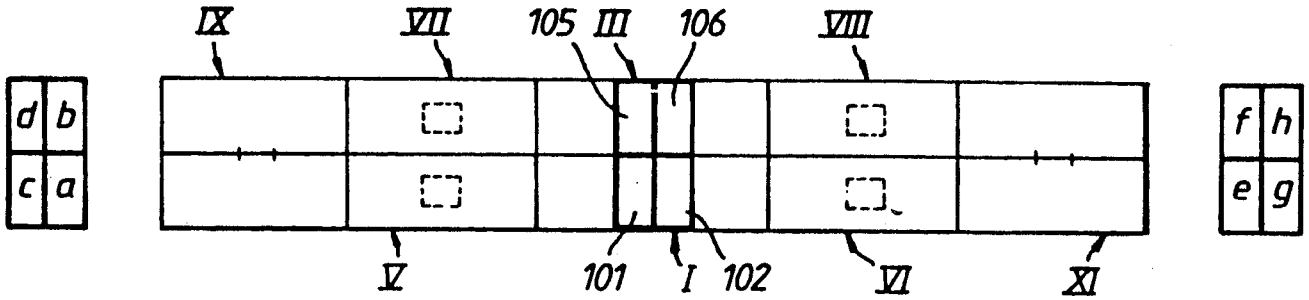
Figure 11B:
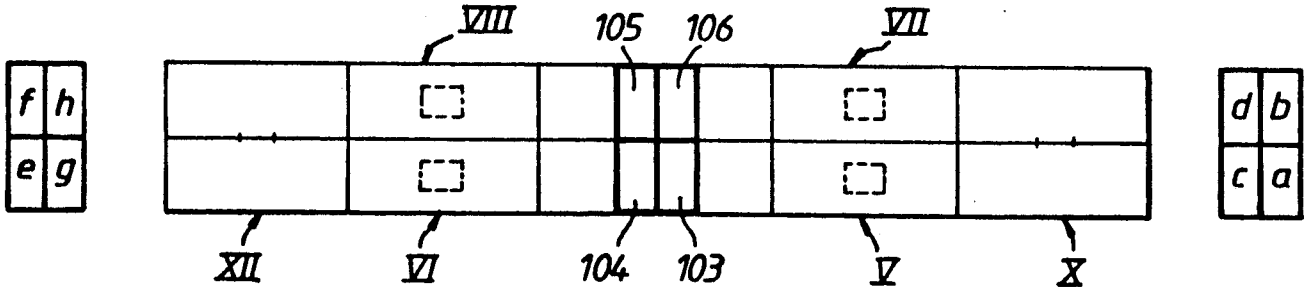

FIG. 7 is a functional diagram of an input or output coupling network for an 8-way shared power amplifier or hybrid transponder similar to FIG. 5(*a*) but showing the node numbering;

FIG. 8 is a top plan view of a further embodiment of an input or output coupling network with waveguide bends in the H-plane;

FIGS. 9(*a*) and (*b*) are elevation views on the embodiment of FIG. 8 taken on arrows A and B respectively;

FIG. 10 is a top plan view of an embodiment of an input or an output coupling network with waveguide bends in the E-plane, and FIGS. 11(*a*) and (*b*) are elevation views on the embodiment of FIG. 10 taken on lines A and B respectively.

DETAILED DISCUSSION OF PREFERRED EMBODIMENTS

Figure 1:
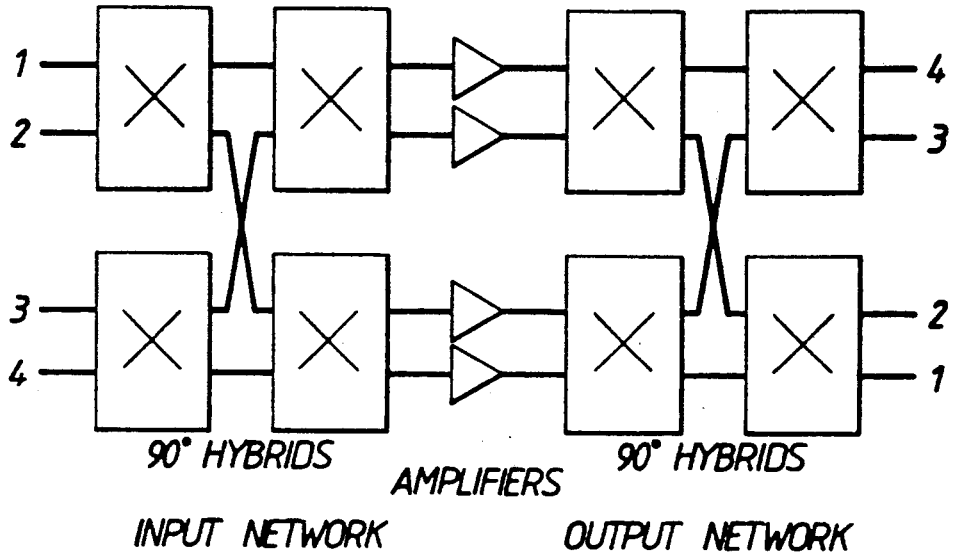
Fig.1. (PRIOR ART)
FIG. 1 is a schematic diagram illustrating a four-way hybrid transponder.

FIG. 1 illustrates a form of hybrid transponder in which four inputs are split and combined to form four equal strength signals which are amplified and then split and recombined to provide amplified output signals which correspond one-for-one with the input signals as indicated by the reference numerals 1 to 4.

Figure 2:
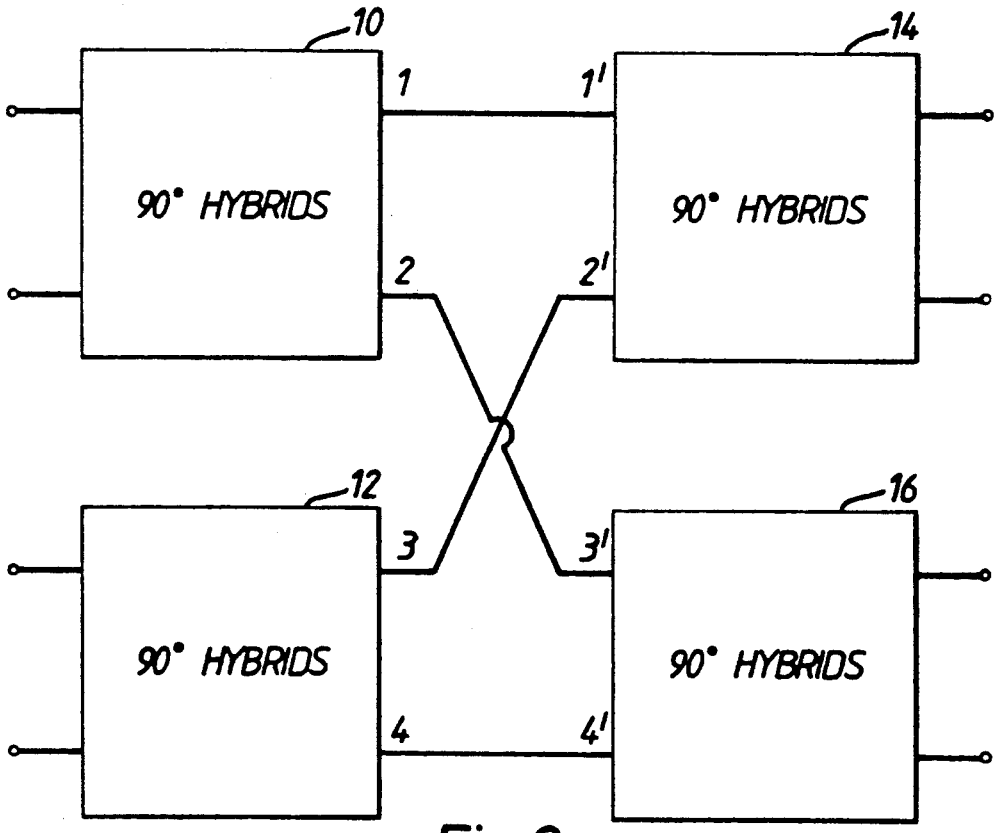
Fig.2. (PRIOR ART)
FIG. 2 is a schematic diagram of the output coupling network of FIG. 1, showing cross-linking.

FIG. 2 shows in detail the output coupling network of FIG. 1. The network is made up of four 90° hybrid couplers 10,12,14 and 16. Conventionally a 90° hybrid coupler is made up of two sections of waveguide side by side with a communicating or coupling aperture. A signal input to one end of one of the waveguides is split with one component passing without phase change to the output end of the same waveguide and the other component passing with 90° phase shift to the output end of the other waveguide. In this example the couplers are 3 dB couplers, i.e. an input signal is divided equally between the outputs. There are two types of coupling: a side wall coupling in which the coupling aperture lies in a wall parallel to the dominant mode electric field and top wall coupling in which the coupling aperture lies in a wall perpendicular to the dominant mode electric field. In a side wall coupler the phase change referred to above is −90° whereas in a top wall coupler it is +90°.

The hybrid couplers 10,12,14 and 16 making up the output network are cross-linked so that output 2 of coupler 10 passes to input 3' of coupler 16 and output 3 of coupler 12 passes to input 2' of coupler 14. This effects the necessary splitting and combining to provide the reconstituted amplified signals at the outputs of the couplers 14 and 16.

Figure 3:
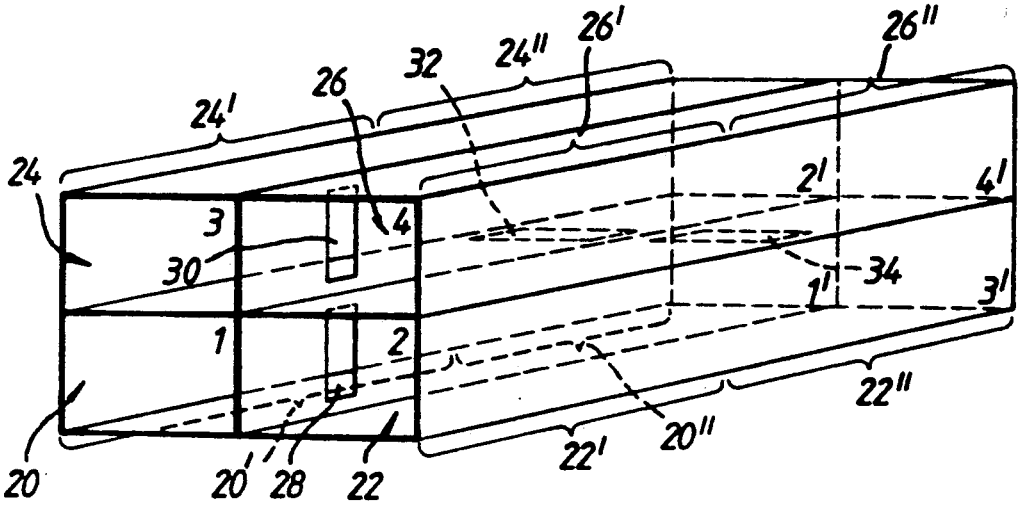
FIG. 3 is a schematic perspective view of an example of a four-way waveguide output coupling network in accordance with the invention.

Referring now to FIG. 3, the illustrated example of the invention comprises a 2×2 rectangular array of waveguides 20,22,24 and 26 which together make up the output network of FIG. 2. Each waveguide is a rectangular hollow pipe made up of a high conductivity material such as copper The inside may be silver-plated to minimize ohmic losses Between the upstream portions 20', 22' of the waveguides 20 and 22 is a side wall coupling aperture 28 and there is a sidewall coupling aperture 30 between the upstream portions 24',26' of waveguides 24 and 26. The downstream portions 20'' and 24'' of waveguides 20,24 are coupled by a top wall coupling aperture 32 and the downstream portions 22'' and 26'' of waveguides 22,26 are coupled by a top wall coupling aperture 34.

Figure 4:
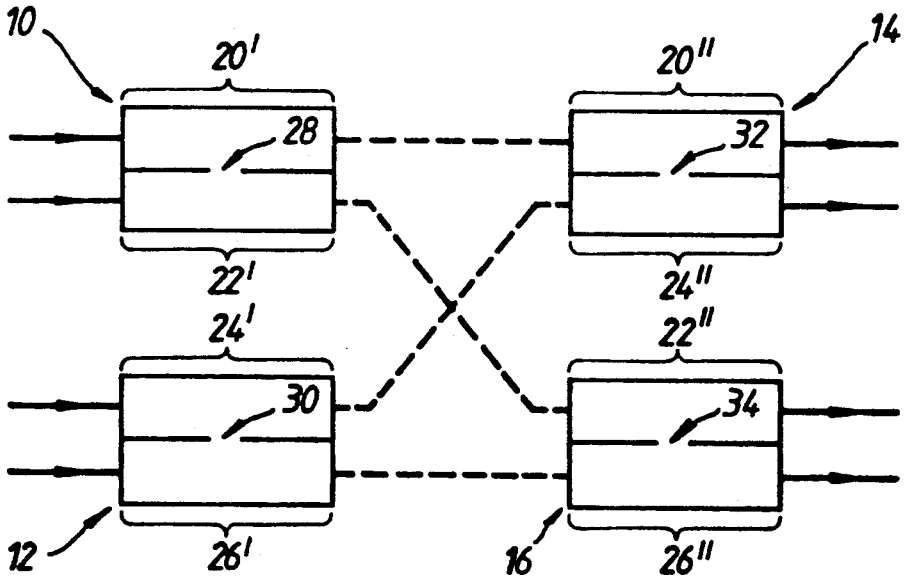
FIG. 4 shows the relation between the schematic representation of FIG. 2 and the hardware shown in FIG. 3.

FIG. 4 shows how the apparently simple structure of FIG. 3 defines the complex cross-linked network of hybrid couplers shown in FIG. 2. For greater understanding the upstream and downstream portions of the waveguides are shown separated and grouped in pairs according to their function. Thus the first stage couplers 10 and 12 of FIG. 2 are made up of the upstream portions 20',22' and coupling aperture 28 and upstream portions 24' and 26' and coupling aperture 30 respectively. Naturally, a signal leaving the upstream portion of a waveguide passes directly into the downstream portion thereof as shown by the dotted lines. The second stage couplers 14 and 16 are made up from the downstream portions 20'' and 24'' and the coupling aperture 32 and downstream portions 22'' and 26'' and the coupling aperture 34.

In this example, the couplers 14 and 16 defined by the network of FIG. 3 are top wall couplers so that the phase shift between the input at one port and the output at the diagonally opposed port is +90°. As compared to an output network made up completely of side wall couplers this will change the distribution of the signals described in the introduction to the specification. There will still be a one-for-one correspondence with the input signals, and the modified distribution is unlikely to cause problems; indeed the modified distribution may be advantageous in some configurations.

FIGS. 1 to 4 illustrate a 4-way network but the embodiment illustrated in FIGS. 3 and 4 may also be incorporated in an 8- or 16-way or higher order transponder.

FIGS. 5(*a*) and 5(*b*) are similar to FIG. 1, but show the interconnections for 8- and 16-way transponders respectively. It will be seen that in both these transponders the first and second input stages 40 of both the input and output network constitute a plurality of "modules" of the type shown in FIG. 2 (2 for the 8-way and 4 for the 16-way). The connections between the second and successive stages are more complex and may need to be realized by conventional techniques.

FIG. 6 is a sketch on an 8-way waveguide output network implementation. This consists of two 4-port basic building blocks 42,44, each corresponding to the module of FIG. 2, whereas the coupling between the second and third stages uses bends and cross-overs. A 16-way implementation could follow similar principles. The amplifiers are supplied to an output network to provide amplified output signals which correspond one-for-one with the input signals. The input network splits and combines the input signals so that each amplifier receives a signal component from each input signal whereby the amplitudes supplied to each amplifier are substantially the same. The output network performs the inverse function so that the output signals correspond one-for-one with the input signals.

Referring now to the embodiments of FIGS. 7 to 11, the input and output networks each comprise a group of interconnected 4-port hybrid couplers shown functionally in FIG. 7 and numbered I to XII. The interconnections are complex, requiring numerous cross-overs between the successive stages of couplers. The applicant has found that, despite this, the network can be realized in a simple and compact waveguide structure of the forms shown in FIGS. 8 or 10.

The structure of FIG. 8 comprises two groups of L-shaped waveguides $\mathbf{110_1}$–$\mathbf{110_4}$ stacked one on the other. The shorter limb $\mathbf{112_1}$–$\mathbf{112_4}$ of each waveguide is the upstream or input end and the longer limb $\mathbf{114_1}$–$\mathbf{114_4}$ is the downstream or output end. In each group, the waveguides are arranged in cruciform shape with the upstream end of a waveguide being coupled by an aperture 116 in a side wall to an upstream end of another waveguide in the same group. The downstream end of a waveguide is coupled in succession by an aperture 116 in a side wall to a downstream end of another waveguide in the same group, and then by an aperture 116 in a top wall to the downstream end of the corresponding waveguide in the other group. This structure gives the functional interconnections of FIG. 7, and the various top and side wall couplers and the node numbers are identified by the corresponding references used in FIG. 7.

The arrangement works as follows:

The inputs 105,106,101 and 102 are fed to two stacked side wall couplers III/I with 3 dB coupling between 105+106 and 101+102. Similarly, the inputs 108,107,104 and 103 are fed to two other stacked side wall couplers IV/II on the opposite side, with couplings between 107+108 and 103+104. H plane waveguide bends are then used to split the eight stacked waveguides by 90°, thereby making all the signal components pass through the same phase. The coupler outputs 105.+107 and 101 +103 are combined using side wall couplers VII/V to give outputs A'+B' and E'+F'. These are then combined through the top wall couplers IX/X to give outputs a,b,c & d. A similar path is followed for the remaining four signals to give outputs e,f,g and h.

FIGS. 9(*a*) and 9(*b*) are side views taken on lines A and B respectively of FIG. 8.

FIG. 10 shows an alternative arrangement which uses E-plane waveguide bends. This arrangement is generally similar to that of FIG. 8 except that the top-wall couplers are replaced by side-wall couplers and vice versa. In this arrangement, the coupling between 101+102, 105+106, 103+104 and 107+108 is released using top wall couplers I, III, II and IV respectively. The next stage of coupling between 101'+103' and 105'+107' is also done by top wall couplers V to VIII. The final coupling is achieved by side wall couplers X to XII.

The topological configurations illustrated above may be used in co-axial line, Microwave Integrated Circuit, strip line or T.E.M. line configurations. Side coupling may be achieved by using branch line or coupled line configurations in the horizontal plane and top coupling may be achieved when these are in the vertical plane.

The configurations may be extended to a sixteen way or even a thirty-two way arrangement. A sixteen way arrangement might use a stacked configuration with two eight way structures. The final level interconnection would be provided by appropriately interconnecting the two sets of eight outputs on the two opposite sides.

I claim:

1. A waveguide network for receiving a plurality of signals and distributing them between a plurality of channels, said network comprising:

a substantially coplanar group of first, second, third and fourth waveguide means, each of said waveguide means being of generally L-shape and having an upstream region and a downstream region, further including means for coupling the upstream regions of the first and second waveguide means together, the upstream regions of the third and fourth waveguide means together, the downstream regions of the first and third waveguide means together, and the downstream regions of the second and fourth waveguide means together, wherein and further including a substantially coplanar group of fifth, sixth, seventh and eighth waveguide means each having a generally L-shape, an upstream region and a downstream region, further including means for coupling the upstream regions of the fifth and sixth waveguide means together, the upstream regions of the seventh and eighth waveguide means together, the downstream regions of the fifth and seventh waveguide means together, and the downstream regions of the sixth and eighth waveguide means together, with means for coupling said first, second, third and fourth waveguide means to an associated one of the fifth, sixth, seventh and eighth waveguide means.

2. A waveguide network according to claim 1, wherein said first, second, third and fourth waveguide means are stacked on associated ones of said fifth, sixth, seventh and eighth waveguide means, with the longitudinal axes of said first mentioned group of waveguide means lying in a common plane parallel to that containing the longitudinal axes of said second mentioned group of waveguide means.

3. A waveguide network comprising eight substantially L-shaped waveguide means each having an upstream region and a downstream region, arranged in two contiguous generally parallel groups of four, the waveguide means in each group being arranged such that each upstream region of a waveguide means is coupled to the upstream region of an adjacent one of the other waveguide means in the group and each downstream region is coupled to the downstream region of an adjacent one of the other waveguide means in the group, whereby each group defines a generally cruciform arrangement with two opposed pairs of signal receiving means and two opposed pairs of signal outlet means, the signal outlet means of each pair thereof in one group being coupled to respective ones of the signal outlet means in the corresponding pair in the other group, whereby the signal supplied to any signal receiving means is distributed between each of the eight waveguide means.

4. A shared power amplifier having an input network, amplifier means and an output network arranged such that the input terminals of the input network have a one-to-one correspondence with the output terminals of the output network, and wherein said output network comprises substantially coplanar first, second, third and fourth waveguide means, each of said waveguide means being of generally L-shape and having an upstream region for receiving a respective signal from said amplifier means and a downstream region, further including means for coupling the upstream regions of said first and second waveguide means together, the upstream regions of said third and fourth waveguide means together, the downstream regions of said first and third waveguide means together, and the downstream regions of said second and fourth waveguide means together.

5. A shared power amplifier according to claim 4, wherein the phase and amplitude coherence of the paths between any one of the input terminals of the input network and any one of the output terminals of the output network are substantially maintained.

6. A shared power amplifier having an input network, amplifier means and an output network arranged such that the input terminals of the input network have a one-to-one correspondence with the output terminals of the output network, and wherein said output network comprises, first, second, third and fourth waveguide means, each of said waveguide means having an upstream region for receiving a respective signal from said amplifier means and a downstream region, further including means for coupling the upstream regions of said first and second waveguide means together, the upstream regions of said third and fourth waveguide means together, the downstream regions of said first and third waveguide means together, and the downstream regions of said second and fourth waveguide means together.

* * * * *